US005492540A

United States Patent [19]

Leifheit et al.

[11] Patent Number: 5,492,540

[45] Date of Patent: Feb. 20, 1996

[54] SOFT SURFACE CLEANING COMPOSITION AND METHOD WITH HYDROGEN PEROXIDE

[75] Inventors: David H. Leifheit; Fred L. Billman; Wayne M. Rees, all of Racine, Wis.

[73] Assignee: S. C. Johnson & Son, Inc., Racine, Wis.

[21] Appl. No.: 258,812

[22] Filed: Jun. 13, 1994

[51] Int. Cl.[6] ..... C11D 3/39; C11D 3/44; D06M 10/06; D06M 10/08

[52] U.S. Cl. ..... 8/111; 252/173; 252/170; 252/DIG. 1; 252/186.28; 252/95; 252/103; 252/104; 252/550; 252/553; 252/554; 252/558; 252/559; 252/DIG. 4; 252/DIG. 14; 252/DIG. 3; 252/8.7; 252/8.9; 252/186.43; 252/186.41; 134/40; 8/137; 106/2

[58] Field of Search ..... 252/173, 170, 252/DIG. 1, DIG. 13, DIG. 19, DIG. 11, DIG. 15, 186.28, 186.29, 95, 103, 104, 550, 552, 553, 554, 558, 559, 172, DIG. 4, DIG. 14, DIG. 15, DIG. 3, 8.7, 8.9, 186.43, 186.41; 134/40; 8/111, 137; 106/2; 427/393.4, 389

[56] References Cited

U.S. PATENT DOCUMENTS

| | | | |
|---|---|---|---|
| 3,462,294 | 8/1969 | Thomas | 106/2 X |
| 3,607,760 | 9/1971 | McIntyre | 8/111 X |
| 3,954,660 | 5/1976 | Kennedy et al. | 252/170 X |
| 4,311,618 | 1/1982 | Schäfer-Burkhard | 252/171 X |
| 4,437,928 | 3/1984 | Wong | 252/79.4 X |
| 4,844,952 | 7/1989 | Korenkiewicz et al. | 427/386 X |
| 4,857,392 | 8/1989 | Kirjanov et al. | 427/430.1 X |
| 4,937,123 | 6/1990 | Chang et al. | 252/8.6 X |
| 5,001,004 | 3/1991 | Fitzgerald et al. | 428/263 |
| 5,084,306 | 1/1992 | McLellan et al. | 427/381 X |
| 5,252,243 | 10/1993 | Minns | 252/103 X |
| 5,284,597 | 2/1994 | Rees | 8/111 X |

*Primary Examiner*—Douglas J. McGinty

[57] ABSTRACT

A soft surface cleaning composition and method for effectively removing oxidizable and non-oxidizable stains without bleaching out the color of the soft surface. Comprising from about 0.2% to about 7.0% by weight of hydrogen peroxide, from about 0.5% to about 4.0% by weight of ethylene glycol n-hexyl ether, from about 0.2% to about 6.0% by weight of a surfactant and the balance water has a cloud point of at least 10° C. remains a single phase at a temperature of about 20° C. to about 40° C. and dries to a non-tacky residue.

30 Claims, No Drawings

SOFT SURFACE CLEANING COMPOSITION AND METHOD WITH HYDROGEN PEROXIDE

FIELD OF THE INVENTION

This invention relates to aqueous cleaning compositions and, more specifically, relates to an aqueous cleaning composition having the ability to remove stains, soils, or combinations thereof from textile fibers.

BACKGROUND OF THE INVENTION

Carpet fibers can be severely and permanently stained or soiled when certain household substances such as coffee, chocolate, mud and fruit drinks are inadvertently spilled on them. These items contain artificial and natural colorants. Many of these colorants are acid dyes which cause the most severe stains, as these acid dyes often attach themselves to available dye sites on the carpet fiber. As a result, some carpets must be prematurely replaced because of unsightly soiling or staining.

Many carpet manufacturers have attempted to prevent unwanted staining of fibers by treating the carpet fibers with a stain resisting coating material. Examples of such stain resisting coatings include condensation productions made from aromatic sulfonic acids, and formaldehyde. Although these coatings have imparted some stain resistance, many of the coatings do not completely eliminate it. In addition, often foot traffic on carpet wears off the coating, leaving the exposed carpet fibers with little or no protection against staining.

Various fluorochemicals have also been applied to carpet fibers in order to reduce their water and oil wettability. The fluorochemical reduces the tendency of soils to adhere to the fibers, thereby making the removal of soils from the carpet fibers easier than if the fluorochemicals were omitted, but offers little protection to the carpet fibers from spills containing acid dye colorants unless the colorants are immediately removed from the fibers. Foot traffic on carpet will often wear off the fluorochemicals as well.

A number of cleaning solutions have been proposed in the past for removing stains and soils from fibers. For instance, volatile solvent dry-cleaning fluids have been proposed, but such fluids are less than satisfactory in removing water-soluble stains or soils. In addition, aqueous compositions containing synthetic detergents have been proposed for removing stains and soils from fibers, but such compositions have not been found to be particularly effective.

One of the problems with these cleaning solutions is that while they may, at times, loosen and/or disperse the soil, they often fail to prevent redeposition of the dispersed soil onto the cleaned carpet fibers. Suspension of the soil in the cleaning liquor allows the soil to be picked up by a cleaning implement such as a cloth or sponge. The soil which is not removed is redeposited on the fibers. For example, it has been found that if residual coffee stains, which are dispersible or soluble in water, remain after cleaning, the stains can be concentrated at the surface of the cleaned carpet as it dries, resulting in an appearance of inadequate cleaning. An additional problem with cleaning solutions is the carpet fibers can become tacky due to film left behind by residual cleaning components. The film attracts and retains soils, which results in a cleaned carpet that will soil more easily after a cleaning than prior thereto. Finally, rinsing current cleaning solutions with large amounts of water causes the fibers in the carpet and, many times, the pad under the carpet, to become saturated with water, which can result in degradation of the pad and/or carpet. The moisture trapped in the padding promotes microbial growth which can present health and/or odor problems.

In order to avoid leaving a tacky residue, formulations based on volatile solvent systems have been proposed. Although these systems clean well without leaving residues, they contain substantial amounts of volatile organic compounds ("VOCs" ) which are regulated because of their potential adverse effects on air quality within the home as well as in the environment. Accordingly, it is an object of the present invention to provide a cleaning composition which effectively removes stains and soil from a soft surface using substantially less VOCs.

It is an additional object of the present invention to provide a method of cleaning a soft surface which requires a minimal amount of rinsing.

It is a further object of the present invention to provide efficacious cleaning composition which removes stains and soil without removing the permanent color from the carpeting.

These objects and others will become apparent to one of ordinary skill in the art from the following description of the present invention.

SUMMARY OF THE INVENTION

The present invention achieves the above-described objectives by providing an aqueous soft surface cleaning composition comprising from about 0.2% to about 7.0% by weight of hydrogen peroxide; from about 0.5% to about 4.0% by weight of ethylene glycol n-hexyl ether ("EGHE"); from about 0.2% to about 6.0% by weight of a surfactant which dries to a non-tacky residue from an aqueous medium; and the balance water. The composition has a cloud point of at least 10° C. and further does not undergo phase separation at a temperatures between about 20° C. to about 40° C. The compositions of the present invention are unexpectedly effective on particulate containing stains such as chocolate and mud which one of ordinary skill would not expect an oxidizing agent such as hydrogen peroxide to effectively remove.

DETAILED DESCRIPTION

The present invention provides a cleaning composition suitable for removing stains and soils from synthetic polymer fibers which overcomes, or at least mitigates, many of the above-described problems.

The aqueous soft surface cleaning compositions of the present invention contain as a first ingredient, hydrogen peroxide. Hydrogen peroxide is generally present in amounts which will not bleach the color of the carpeting Hydrogen peroxide is preferably present in the composition in amounts from about 0.2% to about 7.0%, more preferably, from about 0.5% to about 3.0%, and most preferably, from about 0% to about 2.0% by weight of the composition.

Peroxygen based bleaching systems are currently being used in several household laundry detergents and color-safe laundry bleaches. However, many of the products are dry powders which release hydrogen peroxide upon dissolution in water. This form circumvents the significant instability of hydrogen peroxide in neutral or alkaline aqueous solutions.

Aqueous carpet cleaning compositions containing hydrogen peroxide have also been disclosed in the prior art. These cleaning compositions have typically used high amounts of solvents. For example, U.S. Pat. No. 5,252,243 to Charles Minns discloses cleaning compositions containing about 15% to 20% by weight alcohol such as isopropanol ("IPA") and from about 3% to about 12.5% by weight of hydrogen peroxide. Surprisingly, at least equivalent cleaning is achieved with the formulations of the present invention using significantly less VOCs and a reduced amount of hydrogen peroxide.

In addition, U.S. Pat. No. 3,607,760 to McIntyre claims a composition for removing pet stains from carpets and the like with a composition utilizing 1 to 3 parts of a 3.5% solution of hydrogen peroxide, 10 to 14 parts by weight of ethylene glycol monobutyl ether ("EGBE"), 5 to 15 parts of IPA (or ethanol), about 0.25 to 2 parts of ethylene diamine tetracetic acid ("EDTA") and the water soluble salts thereof and 103 parts water. The '760 patent does not address the use of surfactants nor the resoil problem experienced with the use of some detergents. One of ordinary skill would expect that using a higher amount of solvent as does the '760 patent, superior cleaning would be achieved. However, surprisingly, the compositions of the present invention accomplishes acceptable cleaning to the '760 formulations using from about ten to twenty times less VOCs by weight.

The hydrogen peroxide is preferably stabilized for temperature, pH and the presence of metal ions. If stabilized hydrogen peroxide is not available from the commercial supplier, hydrogen peroxide stabilizers may be added.

Suitable commercial stabilizers for temperature, pH and the presence of metal ions useful in the present invention. These stabilizers include salts of citric acid, phosphonate stabilizers such as diethylenetriaminepenta (methylene phosphonic acid) and its corresponding pentasodium salt available under the trade names Dequest 2060 and Dequest 2066, respectively, from Monsanto Chemical Co. Preferably, the stabilizer is Dequest 2066. The amount of stabilizer needed depends on the grade of hydrogen peroxide used.

The solvent for use in the present invention is typically any water-miscible organic solvent. Suitable solvents include $C_3$-$C_{12}$ alkyl glycol ethers and isopropanol ("IPA"). More preferably, the solvent is selected from the group consisting of EGBE, ethylene glycol hexyl ether ("EGHE") and mixtures thereof. The solvent is typically present in an amount from about 0.5% to about 4.0%, preferably from about 0.75% to about 2.5%, and most preferably from about 1.0% to about 2.0% by weight of the composition. EGBE is available from Union Carbide under the trade name Butyl Cellosolve. EGHE is available under the trade name Hexyl Cellosolve from Union Carbide.

The compositions of the present invention also utilize surfactants for which the final composition dries to a non-tacky or non-sticky residue on the surface of the textile fiber. The use of these types of surfactants reduces the likelihood of resoiling of the fibers after the initial cleaning operation.

Anionic surfactants meeting the above specifications may be used. Preferably, the anionic surfactants include ammonium lauryl sulfate, sodium lauryl sulfate, magnesium lauryl sulfate, alkyl aryl sulfonates such as alkyl naphthalene sodium sulfonate, and mixtures thereof. Most preferably, the surfactant is sodium lauryl sulfate. Alkyl naphthalene sodium sulfonate is available under the trade name Petrol LBA Powder from Witco.

Suitable nonionic surfactants for use in the present invention include ethoxylated long chain alcohols, propoxylated/ethoxylated long chain alcohols such as Poly-Tergents from Olin Corp. and Plurafac from BASF Corp.; ethoxylated nonylphenols, such as the Surfonic N Series available from Texaco; the ethoxylated octylphenols including the Triton X Series available from Rohm & Haas; the ethoxylated primary alcohol series, such as the Neodols available from Shell Chemical; and the ethylene oxide propylene oxide block with polymers such as the Pluronics available from BASF Corp. and mixtures thereof.

Preferably, the nonionic surfactants include primary alcohol ethoxylates, particularly, primary alcohols having 4 moles of ethylene oxide which are available under the trade name Surfonic L24-4 from Texaco or Neodol 23-4 from Shell Oil Corp. Further preferred surfactants include short chain primary alcohols, which are both propoxylated and ethoxylated such as Poly-Tergent SL-22 from Olin Chemical Co. An additional preferred nonionic surfactant includes 3,5 dimethyl hexyn-3-ol available under the trade name Surfynol 61 from Air Products Corp. Nonionic surfactants tend to leave a sticky soil-attracting residue. It has been found that this problem is abated when less than twice the amount, and preferably, equivalent amounts of anionic surfactant is utilized.

Other similar anionic and nonionic surfactants can be substituted for the aforementioned surfactants in the soft-surface cleaners of the present invention, so long as they meet the criteria set forth above.

The surfactants are generally present in an amount from about 0.2% to about 5.0%, preferably from about 0.5% to about 2.0%, and most preferably, from about 0.7% to about 1.5% by weight of the composition.

Water makes up the balance of the compositions of the present invention. Water is typically present in an amount from about 60% to about 98%, preferably from about 70% to about 97%, and most preferably, from about 80% to about 96% by weight of the composition.

The compositions of the present invention have a cloud point of at least 10° C. In addition, the compositions do not undergo phase separation at temperatures between about 20° C. and about 40° C. This allows the formulations to be utilized effectively at typical household temperatures.

Typically, the pH of the present composition is in a range of from about 6 to about 10, preferably, from about 7 to about 9 and most preferably, from about 7.5 to about 8.5. The pH may be adjusted by any pH adjusting agent typically utilized in the art, including citric acid and sodium hydroxide and ammonium hydroxide ("$NH_4OH$"). Preferably, the pH adjusting agent is ammonium hydroxide and citric acid.

Optional ingredients may be added which optimize the cleaning, fragrance and/or shelf life of the compositions of the present invention, including brightener, fragrance and corrosion inhibitors. Generally, these components are included in amounts from about 0% to about 4.0%, preferably, from about 0.05% to about 1.5% by weight of the composition.

Optionally, a stain blocking component may be utilized in the cleaning compositions of the present invention. Typical stainblocking components include water-soluble carboxylated polymer salts. Useful stainblocking components described in U.S. Pat. Nos. 4,937,123 to Chang et al. and 5,001,004 to Fitzgerald et al. Preferably, the stainblocking component is Zelan 338 from DuPont, Fluorad FC-661 and FX-657 from 3M. Most preferably, the stainblocker is Zelan 338 which is 30% active by weight.

The stainblocking component is typically present in an amount from about 0.0% to about 2.5%, preferably, from about 0.05% to about 0.7%, and most preferably, from about 0.1% to about 0.5% by weight of the composition.

The formulations of the present invention may be prepared by any conventional technique. Suitable methods include cold blending or other mixing process. Preferably, the water is the first ingredient and the hydrogen peroxide is the last ingredient to be added in preparing the formulation.

The following examples illustrate the compositions of the present invention, wherein all parts and percentages are by weight and all temperatures in degree Celsius, unless otherwise indicated:

The preferred composition of the present invention using a stabilized cosmetic grade of hydrogen peroxide is as follows:

| Material | % by weight |
|---|---|
| Soft Water | 93.655 |
| Hydrogen Peroxide (50% active) | 2.0 |
| EGHE (Hexyl Cellosolve) | 1.5 |
| Sodium Lauryl Sulfate (30% active) | 1.5 |
| 30% Carboxylated Polymer (Zelan 338) | 0.50 |
| Sodium Citrate, Dehydrate, USP, Granular | 0.32 |
| Ethoxylated/propoxylated short chain linear alcohol (Poly-Tergent SL-22) | 0.25 |
| Fragrance | 0.175 |
| 3,5 Dimethyl Hexyn-3-ol (Surfynol 61) | 0.10 |
| TOTAL PERCENT | 100.00% |

A preferred composition using an unstabilized technical grade of hydrogen peroxide is as follows:

| Material | % by weight |
|---|---|
| Deionized Water | 91.73% |
| Sodium Citrate, USP, Granular, Dihydrate | 0.32% |
| IPA | 2.50% |
| 30% Carboxylated Polymer (Zelan 338) | 0.50% |
| Sodium Lauryl Sulfate | 1.50% |
| EGHE (Hexyl Cellosolve) | 1.50% |
| 3,5 Dimethyl Hexyn-3-ol (Surfynol 61) | 0.25% |
| Fragrance | 0.05% |
| Pentasodium Salt of Diethylenetriamine penta (Methylene Phosphonic Acid) (Dequest 2066) | 0.15% |
| $H_2O_2$ (30% active) | 1.50% |
| TOTAL | 100.00% |

The following comparative examples were conducted to distinguish the present invention over the prior art.

COMPARATIVE STUDY I

A comparative test was conducted to compare the cleaning formulations of the present invention (IB) to compositions disclosed in U.S. Pat. No. 5,284,597 to Wayne M. Rees containing tertiary alkyl hydroperoxides such as tertiary butyl hydroperoxide ("TBHP") (IC). A standard formula (IA) was also prepared which contained no peroxygen components. The formulations were prepared at room temperature by cold blending the ingredients to the water component, the hydrogen peroxide being the last component to be added. One Thousand grams of each of the following formulas were prepared:

| Material | IA (Standard) | Formula IB | Formula IC |
|---|---|---|---|
| Water | 95.655% | 93.655% | 94.225% |

-continued

| Material | IA (Standard) | Formula IB | Formula IC |
|---|---|---|---|
| Sodium Citrate, dihydrate, USP, granular | 0.32% | 0.32% | 0.32% |
| Zelan 338 (50% active) | 0.50% | 0.50% | 0.50% |
| Sodium Lauryl Sulfate (30% active) | 1.50% | 1.50% | 1.50% |
| EGHE (Hexyl Cellosolve) | 1.50% | 1.50% | 1.50% |
| 3,5 dimethyl hexyn-3-ol (Surfynol 61) | 0.10% | 0.10% | 0.10% |
| Fragrance | 0.175% | 0.175% | 0.175% |
| Ethoxylated/propoxylated short chain linear alcohol (Poly-Tergent SL-22) | 0.25% | 0.25% | 0.25% |
| $H_2O_2$ (50% active)* | — | 2.00% | — |
| TBHP (70% active)* | — | — | 1.43% |

*Equal weight % in formulas of the active components

All of the formulas were adjusted to pH 7.5–7.6 by the addition of ammonium hydroxide or citric acid.

The following cleaning protocol was utilized to evaluate the cleaning performance of the compositions on a light beige, 100% nylon 6, 6 carpet with approximately 1.25 cm pile, poor soil resistance and good stainblocking properties. There are three components to the cleaning protocol: stain application, compression cleaning and scoring the cleaning results. The cleaning protocol was performed as a blind study, avoiding bias in cleaning and scoring.

Six stains were chosen for the cleaning protocol. These included: 20% slurry of Brandy Black Research Clay (representing mud); used motor oil Kraft Catalina salad dressing and Ragu Tomato Sauce; chocolate (Hershey's Syrup diluted 1/1 with deionized water); coffee, a (5% deionized water solution of Maxwell House Instant Coffee); and Welch's 100% Grape Juice. These stains were chosen to represent all classes of stains, i.e., particulate matter—Brandy Clay (mud), Ragu Tomato Sauce or Catalina Salad Dressing (tomato parts), dirty motor oil contains suspended particles; oils/fats—Ragu Tomato Sauce or Catalina Salad Dressing (contain soybean oil) and artificial dyes, Hershey's Syrup contains mono—and diglycerides from vegetable oils, dirty motor oil; grape juice and coffee contain lipophillic dyes; water soluble dyes—grape juice and coffee.

Stains were applied with a sponge type blotter, with the exception of Catalina Dressing and Ragu Tomato Sauce. Ragu and Catalina were applied with a pipette and were spread evenly with a spatula on the carpet surface. The staining materials were applied in the following amounts:

| | |
|---|---|
| Clay (mud) | 0.5–0.7 g |
| Chocolate | 0.5–0.7 g |
| Coffee | 1.0–1.3 g |
| Grape Juice | 1.0–1.3 g |
| Oil | 0.4–0.6 g |
| Ragu or Catalina | 0.6–0.7 g |

The amount of stain applied was carefully weighed with a Mettler balance. Round sponge type blotters, 3.75 cm in diameter and 0.125 cm thick, were used to apply the stains.

Stains were applied to white and light colored carpet. This made the stains easier to evaluate. Three sets of six stains were applied to the carpet for each experimental carpet cleaning formula. Stains were allowed to dry 24 hours at a laboratory temperature of about 20° C. and 50% relative humidity before cleaning was performed.

Compression cleaning was performed with the use of sponge blotters. Blotters were soaked with cleaner and pressure was applied directly to the blotter to express cleaner into the carpet. The cleaner was then blotted dry with paper toweling.

Specifically, a sponge blotter, 5 cm in diameter and 0.23 cm wide, was soaked with about 7.0 g of cleaning formula. The formula-soaked blotter was placed directly over the stain. Next, a 75 cm×15 cm piece of grooved glass was placed, grooves down, directly over the sponge blotter. Direct pressure in a downward direction was then applied to the glass for 1–2 seconds by stepping on the glass with complete body weight on one foot. Ten compressions were performed for each stain.

The glass and sponge were then removed, wherein only about I g of product remains in the sponge and about 6 g are delivered to the carpet. The stain was blotted dry by first placing paper toweling (Teri wipes) over the stain. Four blots for each stain were executed by stepping on the paper towel over the stain for 2–3 seconds with one foot.

When the compression cleaning was complete, the carpet was raked and allowed to dry for 24 hours at room temperature of about 20° C. and ambient laboratory humidity of about 50% relative humidity before cleaning was performed. Each group of three sets of stains was labeled with the product blind label. The real products were not revealed until the stain grading is completed.

The dry stains were rated between 24 and 48 hours after cleaning. A five point scale in increments of 0.5 units was used to evaluate cleaning. If a stain was removed completely, a score of 5.0 is given to the stain; if the stain was not removed at all, a rating of 0 was given. Stains were rated as a group; such that three stains were given one score. Groups of stains were rated in relation to all other groups of stains in the scoring process. One person provided initial ratings to the stains and another person reviewed the ratings for possible discrepancies.

Each score was then recorded for each group of stains. Scores for all six types of stains were summed and a composite score was given to each carpet cleaning formula. The superior cleaner has the highest score.

Scores from one test are comparable only when the same standard is used in both tests. Different carpets and different carpet finishes have different cleaning properties making indirect cleaning score comparisons meaningless without internal standards. In addition, rubbing stains such as consumers ordinarily do, introduces a very large error which the above-described blotting technique minimizes.

The cleaning results for the three formulas are as follows:

| | IA | IB | IC |
|---|---|---|---|
| Chocolate | 2.0 | 3.25 | 2.0 |
| Coffee | 2.0 | 2.75 | 1.75 |
| Grape Juice | 2.5 | 4.0 | 2.25 |
| Oil | 2.5 | 2.75 | 2.5 |
| Mud | 2.5 | 2.75 | 1.75 |
| Catalina | 1.0 | 1.0 | 1.0 |
| TOTAL CLEANING | 12.5 | 16.5 | 11.25 |

As shown by the above cleaning scores, compositions of the present invention (IB) achieved superior cleaning scores for particulate containing stains such as chocolate and mud, than a formula of the '497 patent containing equivalent amounts of bleaching components. Surprisingly, the compositions of the present invention also achieved superior results on oxidizable stains such as grape juice and coffee than the '497 composition. This is surprising because one of ordinary skill would have expected that a TBHP, an oxidizer of relatively comparable strength to hydrogen peroxide, would have achieved at least equivalent cleaning on oxidizable stains.

COMPARATIVE STUDY II

A comparative test was conducted between compositions from claim 6 of U.S. Pat. No. 3,607,760 to McIntyre (IIA), the closest example from the '760 patent to the present invention (IIB) and the composition of the present invention (IIC). The formulations were prepared by the same method as described in Comparative Study I. The formulations are as follows:

| Material | IIA | IIB | IIC |
|---|---|---|---|
| Water | 81.68% | 87.00% | 95.93% |
| EGBE (Butyl Cellosolve) | 10.00% | 8.30% | — |
| IPA | 7.80% | 4.20% | — |
| EDTA, (50% active) (Versene 100) | 0.40% | 4.20% | — |
| $H_2O_2$ (50% active) (Cosmetic grade) | 0.12% | 0.18% | 0.40 |
| Sodium Citrate, dehydrate, USP, granular | — | — | 0.32% |
| Ethoxylated/propoxylated short chain linear alcohol (Poly-Tergent SL-22) | — | — | 0.25% |
| Sodium Lauryl Sulfate (30% active) | — | — | 1.50% |
| 3,5 dimethyl hexyn-3-ol (Sulfynol 61) | — | — | 0.10% |
| EGHE (Hexyl Cellosolve) | — | — | 1.50% |

The pH of the formulations were adjusted to 7.0 with the addition of granular sodium citrate, dihydrate, USP.

The cleaning protocol as described in Comparative Study I was utilized to evaluate the cleaning performance of the composition on a light beige, 100% nylon 6, 6 carpet having about 1.25 cm pile, poor soil resistance and good stainblocking properties. The cleaning results of the above formulations are as follows:

| | IIA | IIB | IIC |
|---|---|---|---|
| Chocolate | 1.0 | 1.0 | 2.0 |
| Coffee | 1.0 | 3.0 | 3.0 |
| Grape Juice | 2.5 | 2.5 | 2.5 |
| Oil | 1.0 | 1.0 | 2.0 |
| Mud | 1.0 | 1.0 | 2.0 |
| Ragu | 2.0 | 2.0 | 2.0 |
| TOTAL CLEANING | 10.5 | 10.5 | 13.5 |

One of ordinary skill would expect superior stain removal using higher amounts of VOCs as in the '760 formulations (Ella and IIB). However, as shown by the above cleaning scores, the composition of the present invention IIC having about one-seventh to about one-tenth of the solvent amount and containing no alcohol achieved substantially equivalent cleaning scores on three of the six stains (coffee, grape juice and Ragu) and superior cleaning on remaining three of six (oil, chocolate and mud) stains.

COMPARATIVE STUDY III

A comparative study was conducted between compositions described in U.S. Pat. No. 5,252,243 to Minns (IIIA and IIIB) and a composition of the present invention (IIIC). Formula IIIA contains the lowest amount of peroxide and the highest amount of solvent disclosed in the '243 patent and adjusted to a pH of 9.0 with ammonium hydroxide. Formula IIIB contains the preferred formula enumerated in claim 8 of the '243 patent. Formula IIIC of the present invention was adjusted to a pH of 7.0 with ammonium hydroxide.

| Material | IIIA | IIIB | IIIC |
|---|---|---|---|
| Water | 74.0% | 72.0% | 74.0% |
| IPA | 20.0% | 10.0% | — |
| $H_2O_2$ (50% active), cosmetic grade | 6.0% | 18.0% | 14.0% |
| 3,5 dimethyl hexyn-3-ol (Surfynol 61) | — | — | 1.0% |
| Ethoxylated/propoxylated short chain linear alcohol (Poly-Tergent SL-22) | — | — | 0.5% |
| Ammonium Lauryl Sulfate (30% active) | — | — | 8.0% |
| EGHE (Hexyl Cellosolve) | — | — | 2.5% |

The same cleaning protocol described in Comparative Study I was used to evaluate the cleaning performance of the above formulas except that the test carpet was a white, 100% nylon 6, 6, 1.25 cm pile carpet having poor anti-resoil and good water repellency.

| | IIIA | IIIB | IIIC |
|---|---|---|---|
| Chocolate | 3.5 | 4.0 | 2.0 |
| Coffee | 2.5 | 2.5 | 2.5 |
| Grape Juice | 4.5 | 4.5 | 4.5 |
| Oil | 1.5 | 1.0 | 2.0 |
| Mud | 2.0 | 2.5 | 2.5 |
| Ragu | 2.0 | 2.0 | 2.0 |
| TOTAL CLEANING | 16.0 | 16.5 | 15.5 |

Although the formulas from the '243 patent achieve better stain removal on chocolate, the composition of the present invention demonstrated equivalent cleaning results on the other stains tested, using about ten to twenty times less VOCs than the '243 formulations.

Industrial Applicability

Therefore, the soft surface cleaning compositions of the present invention may be used to effectively remove oxidizable and particulate containing stains without bleaching out the color of the soft surface or using substantially high levels of VOCs.

Other modifications and variations of the present invention will become apparent to those skilled in the art from an examination of the above Specification. Therefore, other variations of the present invention may be made which fall within the scope of the appended claims even though such variations were not specifically discussed above.

We claim:

1. An aqueous soft surface cleaning composition comprising:

(a) from about 0.5% to about 7.0% by weight of hydrogen peroxide;

(b) from about 0.5% to about 4.0% by weight of ethylene glycol n-hexyl ether;

(c) from about 0.2% to about 6.0% by weight of a surfactant; and (d) the balance water, wherein the composition has a cloud point of at least about 10° C., remains a single phase at a temperature of about 20° C. to about 40° C. and forms a non-tacky residue upon drying.

2. The aqueous soft surface cleaning composition as claimed in claim 1, wherein the hydrogen peroxide is present in an amount of from about 0.5% to about 3.0% by weight of the composition.

3. The aqueous soft surface cleaning composition as claimed in claim 1, wherein the hydrogen peroxide is present in an amount of from about 1.0% to about 2.0% by weight of the composition.

4. The aqueous soft surface cleaning composition as claimed in claim 1, wherein the ethylene glycol n-hexyl ether is present in all amount of from about 0.75% to about 2.5% by weight of the composition.

5. The aqueous soft surface cleaning composition as claimed in claim 1, wherein the ethylene glycol n-hexyl ether is present in an amount of from about 1.0% to about 2.0% by weight of the composition.

6. The aqueous soft surface cleaning composition as claimed in claim 1, wherein the surfactant is present in an amount of from about 0.5% to about 2.0% by weight of the composition.

7. The aqueous soft surface cleaning composition as claimed in claim 1, wherein the surfactant is present in an amount of from about 0.7% to about 1.5% by weight of the composition.

8. The aqueous soft surface cleaning composition as claimed in claim 1, wherein the surfactant is selected from the group consisting of ammonium lauryl sulfate, sodium lauryl sulfate, magnesium lauryl sulfate, 3,5 dimethyl hexyn-3-ol, alkyl naphthalene sodium sulfonate and mixtures thereof.

9. The aqueous soft surface cleaning composition as claimed in claim 1, wherein the surfactant is selected from the group consisting of sodium lauryl sulfate, 3,5 dimethyl hexyn-3-ol and mixtures thereof.

10. The aqueous soft surface cleaning composition as claimed in claim 1, further comprising from about 0.0% to about 2.5% by weight of a stainblocking component.

11. The aqueous soft surface cleaning composition as claimed in claim 1, further comprising from about 0.05% to about 0.7% by weight of a stainblocking component.

12. The aqueous soft surface cleaning composition as claimed in claim 1, further comprising from about 0.1% to about 0.5% by weight of a stainblocking component.

13. The aqueous soft surface cleaning composition as claimed in claim 1, having a pH in the range of about 6 to about 10.

14. The aqueous soft surface cleaning composition as claimed in claim 1, having a pH in the range of about 7 to about 9.

15. The aqueous soft surface cleaning composition as claimed in claim 1, having a pH in the range of about 7.5 to about 8.5.

16. A method of cleaning a soft surface, comprising the steps off:

(a) applying an effective amount of a cleaning composition to a softed or stained soft surface, and (b) removing any excess cleaning composition, the cleaning composition comprising:

(i) from about 0.5% to about 7.0% by weight of hydrogen peroxide;

(ii) from about 0.5% to about 4.0% by weight ethylene glycol n-hexyl (iii) from about 0.2% to about 6.0% by weight of a surfactant; and (iv) the balance water, wherein the composition has a cloud point of at least 10° C., remains a single phase at a temperature of about 20° C. to about 40° C. and dries to a non-tacky residue (b) removing the cleaning composition from the soft surface.

17. The method of cleaning a soft surface as claimed in claim 16, wherein hydrogen peroxide is present in an amount of from about 0.5% to about 3.0% by weight of the composition.

18. The method of cleaning a soft surface as claimed in claim 16, wherein hydrogen peroxide is present in an amount of from about 1.0% to about 2.0% by weight of the composition.

19. The method of cleaning a soft surface as claimed in claim 16, wherein the ethylene glycol n-hexyl ether is present in an amount of from about 0.75% to about 2.5% by weight of the composition.

20. The method of cleaning a soft surface as claimed in claim 16, wherein the ethylene glycol n-hexyl ether is present in an amount of from about 1.0% to about 2.0% by weight of the composition.

21. The method of cleaning a soft surface as claimed in claim 16, wherein the surfactant is present in an amount of from about 0.5% to about 2.0% by weight of the composition.

22. The method of cleaning a soft surface as claimed in claim 16, wherein the surfactant is present in an amount of from about 0.7% to about 1.5% by weight of the composition.

23. The method of cleaning a soft surface as claimed in claim 16, wherein the surfactant is selected from the group consisting of ammonium lauryl sulfate, sodium lauryl sulfate, magnesium lauryl sulfate, 3,5 dimethyl hexyn-3-ol, alkyl naphthalene sodium sulfonate and mixtures thereof.

24. The method of cleaning a soft surface as claimed in claim 16, wherein the surfactant is selected from the group consisting of sodium lauryl sulfate, 3,5 dimethyl hexyn-3-ol and mixtures thereof.

25. The method of cleaning a soft surface as claimed in claim 16, wherein the cleaning composition further comprises from about 0.0% to about 2.5% by weight of a stainblocking component.

26. The method of cleaning a soft surface as claimed in claim 16, wherein the cleaning composition further comprises from about 0.05% to about 0.7% by weight of a stainblocking component.

27. The method of cleaning a soft surface as claimed in claim 16, wherein the cleaning composition further comprises from about 0.01 to about 0.5% by weight of a stainblocking component.

28. The method of cleaning a soft surface as claimed in claim 16, wherein the cleaning composition has a pH in the range of about 6 to about 10.

29. The method of cleaning a soft surface as claimed in claim 16, wherein the cleaning composition has a pH in the range of about 7 to about 9.

30. The method of cleaning a soft surface as claimed in claim 16, wherein the cleaning composition has a pH in the range of about 7.5 to about 8.5.

* * * * *

UNITED STATES PATENT AND TRADEMARK OFFICE

CERTIFICATE OF CORRECTION

PATENT NO. : 5,492,540
DATED : February 20, 1996
INVENTOR(S) : Leifheit, et al.

It is certified that error appears in the above-identified patent and that said Letters Patent is hereby corrected as shown below:

Column 9, line 51, "0.5%" should read --0.2%--.
Column 10, line 5, "all" should read --an--.
Column 10, line 46, "off" should read --of--.
Column 10, line 52, "0.5%" should read --0.2%--.
Column 10, line 62, delete entire line.
Column 10, line 63, delete line.
Column 12, line 13, "0.01" should read --0.1%--.

Signed and Sealed this

Ninth Day of January, 2001

*Attest:*

Q. TODD DICKINSON

*Attesting Officer*

*Commissioner of Patents and Trademarks*